US006605029B1

(12) United States Patent
Koch et al.

(10) Patent No.: US 6,605,029 B1
(45) Date of Patent: Aug. 12, 2003

(54) CENTRIFUGE WITH OPEN CONVEYOR AND METHODS OF USE

(75) Inventors: Richard James Koch, Magnolia, TX (US); Kenneth W. Seyffert, Houston, TX (US); John Patrick Wright, Kerrville, TX (US); Subrata Mitra, The Woodlands, TX (US)

(73) Assignee: Tuboscope I/P, Inc., Houston, TX (US)

( * ) Notice: Subject to any disclaimer, the term of this patent is extended or adjusted under 35 U.S.C. 154(b) by 40 days.

(21) Appl. No.: 09/652,418

(22) Filed: Aug. 31, 2000

(51) Int. Cl.[7] ..... B04B 1/20
(52) U.S. Cl. ..... 494/53
(58) Field of Search ..... 494/52–54, 56, 494/84; 210/377, 380.1, 380.3

(56) References Cited

U.S. PATENT DOCUMENTS

| | | | | |
|---|---|---|---|---|
| 832,191 | A | * | 10/1906 | Holzer |
| 924,376 | A | * | 6/1909 | Phillips |
| 1,027,134 | A | * | 5/1912 | Leitch |
| 1,572,299 | A | * | 2/1926 | McEntire |
| 1,806,241 | A | * | 5/1931 | Dupuis |
| 1,885,154 | A | | 11/1932 | Strezynski et al. |
| 2,129,992 | A | * | 9/1938 | De Mattia |
| 2,578,456 | A | | 12/1951 | Smith |
| 2,612,314 | A | | 9/1952 | Huelsdonk |
| 2,703,676 | A | | 3/1955 | Gooch |
| 2,711,854 | A | | 6/1955 | Kjellgren |
| 2,961,154 | A | | 11/1960 | Bergey |
| 3,070,291 | A | | 12/1962 | Bergey |
| 3,268,159 | A | | 8/1966 | Kern |
| 3,568,920 | A | | 3/1971 | Nielsen |
| 3,795,361 | A | | 3/1974 | Lee |
| 3,885,734 | A | | 5/1975 | Lee |
| 3,934,792 | A | | 1/1976 | High et al. |
| 4,000,074 | A | | 12/1976 | Evans |
| 4,070,290 | A | | 1/1978 | Crosby |
| 4,085,888 | A | | 4/1978 | Jager |
| 4,209,128 | A | | 6/1980 | Lyons |
| 4,228,949 | A | | 10/1980 | Jackson |
| 4,240,578 | A | | 12/1980 | Jackson |
| 4,262,841 | A | | 4/1981 | Berber et al. |
| 4,298,160 | A | | 11/1981 | Jackson |
| 4,298,162 | A | | 11/1981 | Hohne |
| 4,327,862 | A | | 5/1982 | Jakobs |

(List continued on next page.)

FOREIGN PATENT DOCUMENTS

| | | | |
|---|---|---|---|
| DE | 193997 | | 7/1904 |
| EP | 0602766 | | 6/1994 |
| FR | 384326 | * | 4/1908 |
| GB | 1053222 | | 12/1966 |
| JP | 54-139167 | * | 10/1979 |

OTHER PUBLICATIONS

SC—35 HS High Speed Decanting Centrifuge, Sweco Oilfield Services, 1995.

(List continued on next page.)

*Primary Examiner*—Charles E. Cooley
(74) *Attorney, Agent, or Firm*—Guy McClung

(57) ABSTRACT

A conveyor for a centrifuge and a centrifuge with such a conveyor, the conveyor having a plurality of spaced-apart flight members spaced apart along its length, a plurality of support members extending between, and connected to the flight members, the support members spaced-apart around the flight members, the members and support members defining a plurality of open areas through which fluid to be treated by the centrifuge is flowable from within the conveyor out into the bowl. In one aspect, a fluid velocity decreasing chamber is provided between an exit tube end and impeller apparatus for radially accelerating the fluid with the conveyor. In certain aspects the open "caged" conveyor structures diffuses fluid flow from the conveyor so that a dispersed unfocused flow of fluid exits the conveyor into the bowl, and, in one particular aspect with feed from within the conveyor to space adjacent a beach area of the bowl.

26 Claims, 10 Drawing Sheets

U.S. PATENT DOCUMENTS

| | | | | |
|---|---|---|---|---|
| 4,334,647 | A | 6/1982 | Taylor | |
| 4,339,072 | A | 7/1982 | Hiller | |
| 4,378,906 | A | 4/1983 | Epper et al. | |
| 4,411,646 | A | 10/1983 | Cyphelly | |
| 4,743,226 | A | 5/1988 | Day et al. | |
| 4,961,722 | A | 10/1990 | Taylor et al. | |
| 5,147,277 | A | 9/1992 | Shapiro | 494/53 |
| 5,182,020 | A | 1/1993 | Grimwood | |
| 5,203,762 | A | 4/1993 | Cooperstein | 494/7 |
| 5,354,255 | A | * 10/1994 | Shapiro | |
| 5,364,335 | A | 11/1994 | Franzen et al. | 494/15 |
| 5,374,234 | A | * 12/1994 | Madsen | |
| 5,378,364 | A | 1/1995 | Welling | |
| 5,380,266 | A | 1/1995 | Leung et al. | 494/53 |
| 5,401,423 | A | 3/1995 | Leung et al. | |
| 5,403,260 | A | 4/1995 | Hensley | 494/53 |
| 5,403,486 | A | 4/1995 | Leung | |
| 5,423,734 | A | 6/1995 | Leung | 494/53 |
| 5,520,605 | A | 5/1996 | Leung et al. | 494/50 |
| 5,527,258 | A | 6/1996 | Leung et al. | 494/53 |
| 5,527,474 | A | 6/1996 | Leung | |
| 5,545,119 | A | * 8/1996 | Schilp et al. | |
| 5,551,943 | A | 9/1996 | Leung et al. | 494/53 |
| 5,586,966 | A | * 12/1996 | Wood | |
| 5,632,714 | A | 5/1997 | Leung et al. | 494/53 |
| 5,643,169 | A | 7/1997 | Leung et al. | |
| 5,651,756 | A | 7/1997 | Leung | 494/53 |
| 5,653,674 | A | 8/1997 | Leung | 494/53 |
| 5,658,232 | A | 8/1997 | Leung | 494/50 |
| D386,874 | S | 11/1997 | Glaun | D34/29 |
| 5,683,343 | A | 11/1997 | Leung | 494/52 |
| D387,534 | S | 12/1997 | Glaun | D34/29 |
| D388,583 | S | 12/1997 | Glaun | D34/29 |
| 5,695,442 | A | 12/1997 | Leung et al. | 494/37 |
| D388,924 | S | 1/1998 | Glaun | D34/29 |
| 5,769,776 | A | 6/1998 | Leung et al. | 494/53 |
| 5,771,601 | A | 6/1998 | Veal et al. | |
| 5,772,573 | A | 6/1998 | Hao | 494/15 |
| 5,814,230 | A | 9/1998 | Willis et al. | |
| 5,840,006 | A | 11/1998 | Leung et al. | 494/53 |
| 5,913,767 | A | 6/1999 | Feldkamp et al. | 494/4 |
| 5,942,130 | A | 8/1999 | Leung | |
| 5,948,256 | A | 9/1999 | Leung | |
| 5,948,271 | A | 9/1999 | Wardwell et al. | |
| 5,958,235 | A | 9/1999 | Leung | |
| 5,971,907 | A | * 10/1999 | Johannemann et al. | |
| 6,063,292 | A | 5/2000 | Leung | |
| 6,077,210 | A | 6/2000 | Leung et al. | 494/53 |
| 6,109,452 | A | 8/2000 | Leung et al. | |
| 6,110,096 | A | 8/2000 | Leung et al. | 494/53 |
| 6,123,656 | A | 9/2000 | Michelsen | |
| 6,143,183 | A | 11/2000 | Wardwell et al. | |
| 6,145,669 | A | 11/2000 | Leung | |
| 6,193,070 | B1 | 2/2001 | Rowney et al. | |
| 6,193,076 | B1 | 2/2001 | Hensley | |
| 6,230,899 | B1 | 5/2001 | Hensley | |
| 6,241,901 | B1 | 6/2001 | Leung | |
| 6,267,250 | B1 | 7/2001 | Leung et al. | |
| D448,488 | S | 9/2001 | Chaffiotte et al. | D24/219 |
| 6,432,299 | B1 | 8/2002 | Hensley et al. | |

OTHER PUBLICATIONS

Roots XLP Whispair Extra Low Pulse Tri–Lobe Blowers, Roots Dresser, 1998.

Industrial Model 1850 SS FVSI, Brandt/South–West, 1998.

SC–35 HS High Speed Decanting Centrifuge, Brandt/EPI, 2 pp., 1996.

SC–4 Decanting Centrifuge, 2 pp. Brandt, 1997.

"Low Pressure Mud Systems For Deepwater Operations," Montgomery, Hart's Petroleum Engineer Int'l, Dec. 1997.

SWACO GEOLOGRAPH, 1993 Catalog, pp. 9, 12, 20; 1993.

"Committed To Excellence In Manufacturing & Rebuilding For The Centrifuge Industry," Brandt/Southwest, 1991.

Solids Control Equipment, Centrifuges, Kem–Tron Technologies, Inc., 2002.

A Complete Line of Solids Control Equipment, Derrick Equipment Co., p. 12, 2002 (centrifuge introduced 2001).

* cited by examiner

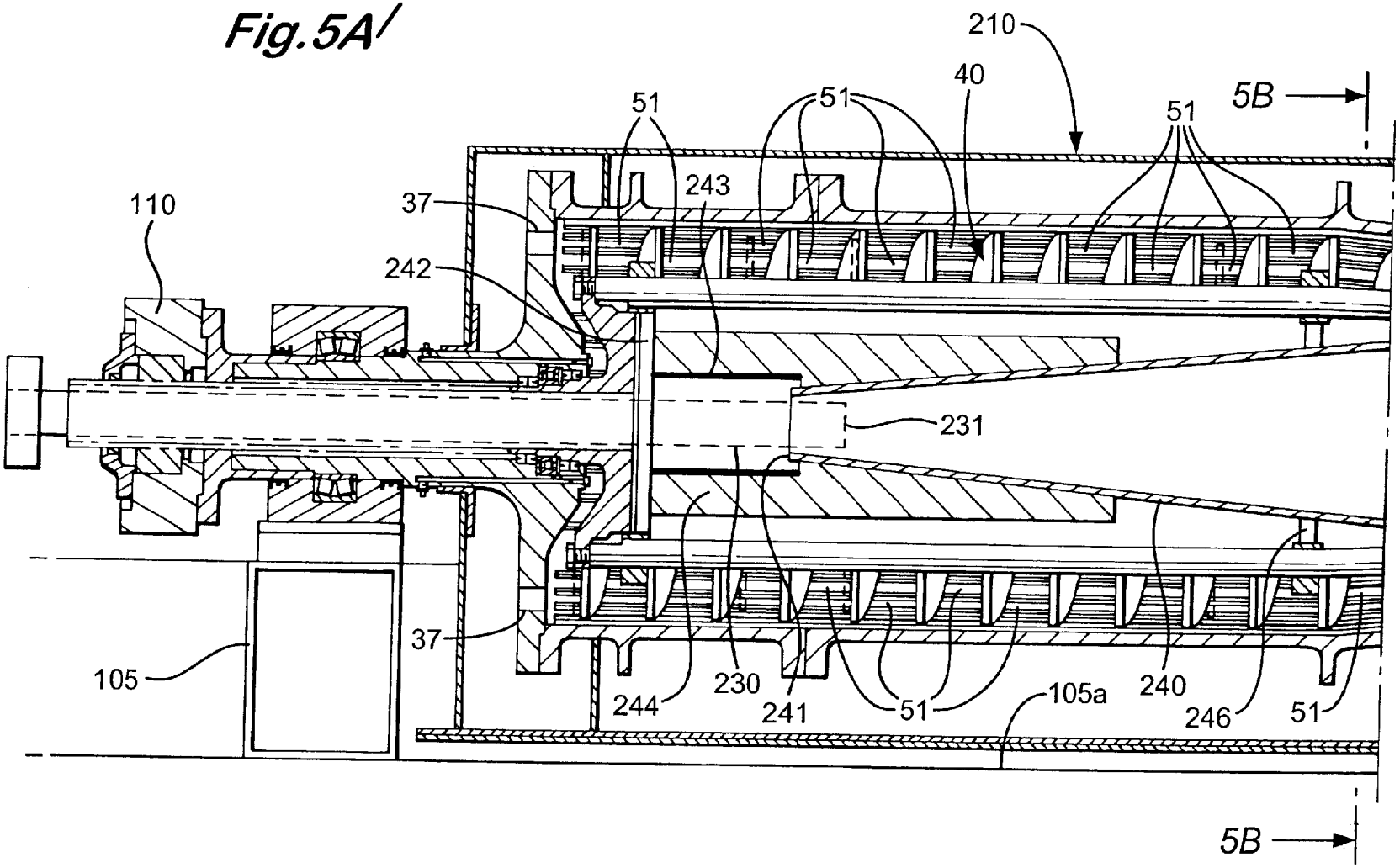
Fig. 5A/

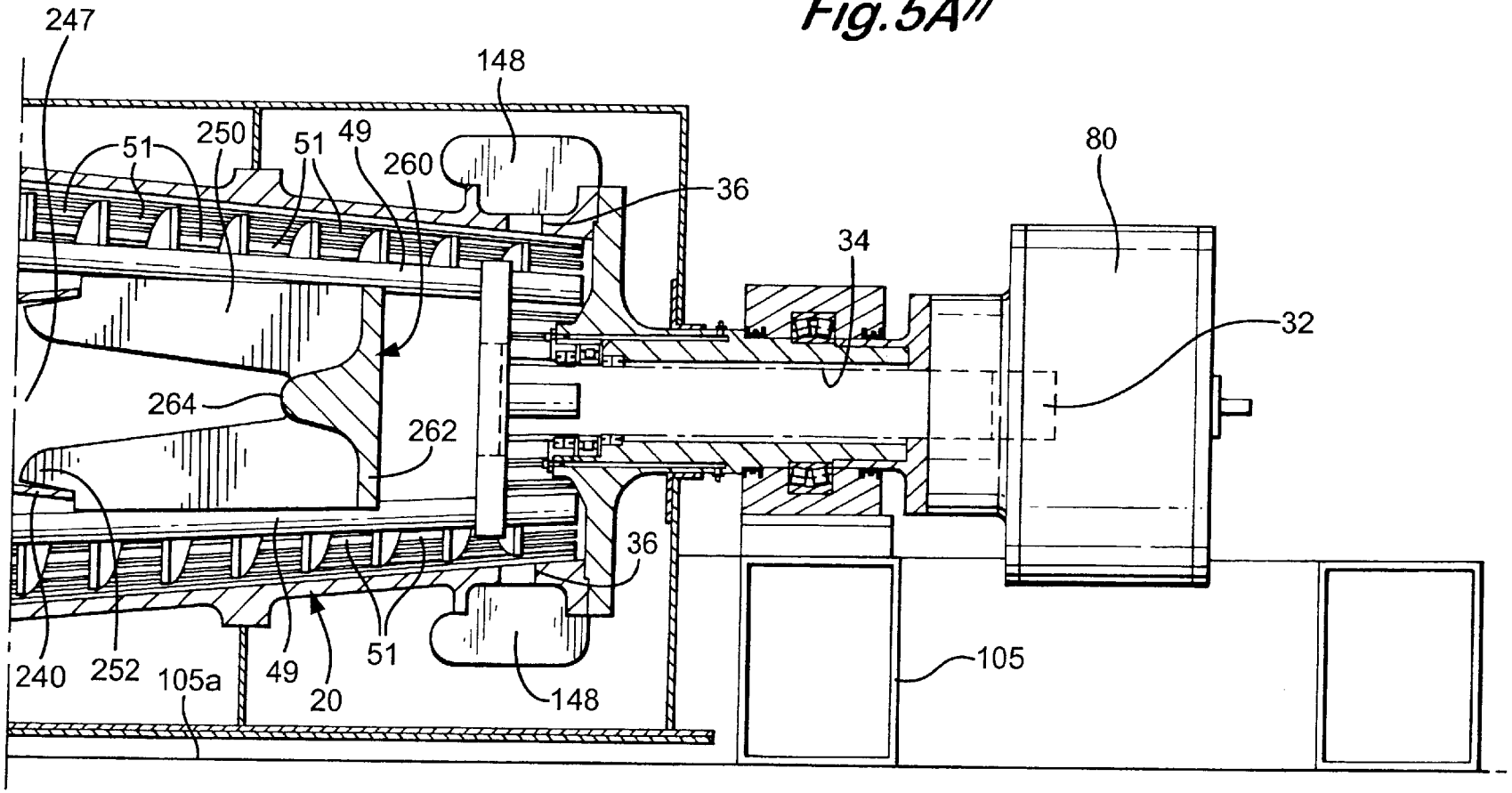
Fig. 5A//

CENTRIFUGE WITH OPEN CONVEYOR AND METHODS OF USE

BACKGROUND OF THE INVENTION

1. Field of the Invention

This invention relates generally to centrifuges, and more particularly to decanting centrifuges with a rotating bowl and scroll.

2. Description of Related Art

The prior art discloses a variety of decanter centrifuges or "decanters" which, in many embodiments, include a rotating centrifuge bowl rotating at one speed and in which a screw conveyor ("scroll") revolves at a slightly different speed. Such centrifuges are capable of continuously receiving feed in the bowl and of separating the feed into layers of light and heavy phase materials (e.g. liquids and solids) which are discharged separately from the bowl. The screw conveyor structure, rotating at a differential speed with respect to the bowl, moves or "scrolls" an outer layer of heavy phase or solids slurry material to a discharge port or ports usually located in a tapered or conical end portion of the bowl. Centrifugal force tends to make the light phase material discharge through one or more ports usually located at an opposite end of the bowl. Typically the bowl is solid. Some bowls have Port(s) to reject the heavier solids phases.

Centrifugal separation results, preferably, in a discharge containing light phase material with little or no heavy phase material, and heavy phase material containing only a small amount of light phase material. When the light phase material is water and the heavy phase material contains soft solids, it is preferred that fairly dry solids and clean water be separately discharged.

Many different industries use decanter centrifuges in varied applications. They are used in the oil industry to process drilling mud to separate undesired drilling solids from the liquid mud. Some decanter centrifuges, because of their continuous operation, have the advantage of being less susceptible to plugging by solids. Also, they may be shut down for long or short periods of time and then restarted with minimum difficulty, unlike certain centrifuges which require cleaning to remove dried solids. Often the solids/liquid mixture is processed at extraordinarily high feed rates. To accommodate such feed rates, high torques are encountered, much energy is required to process the mixture, and the physical size of the centrifuge can become enormous.

As larger feed volumes are processed in a given centrifuge machine, the clarification capability of the centrifuge decreases due to decreased retention or residence time, partial-acceleration or nonacceleration (slippage) of the feed fluid (the solids/liquid mixture), radial deceleration of the fluid moving through the conveyor, and turbulence created by the movement and/or focusing of large volumes of fluid through ports that tend to transmit and/or focus a high volume flow in an area exterior to the conveyor that induces undesirable turbulence in that area and results in excess wear and abrasion to parts that are impacted by this flow. The turbulent fluid exiting from the ports impedes or prevents solids from flowing to solids exit ports and ports near the centrifuge's drainage deck or "beach" impedes solids flow up the beach.

FIG. 1 shows one typical prior art decanting centrifuge that removes free liquid from separated solids. A rotating bowl creates very high G-forces and forms a liquid pool inside the bowl. The free liquid and finer solids flow towards the larger end of the centrifuge and are removed through effluent overflow weirs. Larger solids settle against the bowl wall, forming a cake. These solids are pushed by a screw conveyor up out of the pool and across a drainage deck (conical section), or "beach". Dewatering or drying takes place during the process of the solids moving up the beach, with the deliquified solids discharged through a series of underflow solids ports. A gear box connects the conveyor to the bowl, causing the conveyor to rotate in the same direction as the bowl, but at a slightly different speed. This speed differential is required to convey and discharge solids.

The interior end of the feed tube is relatively close to a wall or member defining an end of an acceleration chamber, thus fluid exiting from the feed tube into the acceleration chamber has relatively little space in which to slow down. This relatively high speed fluid is, therefore, turbulent and can wear away parts of the acceleration chamber. Also exiting from the acceleration chamber via exit ports this turbulent-relatively-high-speed fluid can inhibit the desired flow of separated solids both in the bowl toward the solids exit ports and toward the beach area and can wear away parts of the conveyor and bowl adjacent the acceleration chamber exit ports. Rather than dispersing and slowing down the fluid exiting from the acceleration chamber, the exit ports focus and/or speed up the fluid flow.

SUMMARY OF THE PRESENT INVENTION

The present invention, in certain aspects, discloses a new decanting centrifuge which has a rotatable bowl within which rotates a caged conveyor at a different speed than the speed of rotation of the bowl. In certain aspects a caged or skeleton conveyor according to the present invention includes a plurality of spaced-apart flights within which and to which are secured a plurality of spaced-apart support beams, rods, or members so that fluid can flow freely with reduced turbulence between the beams, rods or members, into and out from the interior of the conveyor. The flights form a screw portion of the conveyor for conveying solids separated from fluid to be treated by the centrifuge from one end of the bowl to the other (at which there are one or more solids outlets). In one aspect the flights are in the form of a helix.

The present invention, in certain aspects, provides a decanting centrifuge with a relatively short feed tube or inlet nozzle (providing a larger or longer area for reduction of fluid velocity, reduction of feed tube vibration, and turbulence reduction) and one or more impeller's on the conveyor's interior which are impacted by fluid entering the centrifuge through the feed tube or inlet nozzle. In certain aspects the impellers (and related parts such as a nose member, chamber, and base) are made of material from the group of steel, stainless steel, hardfaced or carbide covered metal, plastic, molded poly urethane, fiberglass, polytetrafluoroethylene, aluminum, aluminum alloy, zinc, or zinc alloy, stellite, nickel, chrome, boron and/or alloys of any of these. The impellers (and related parts) may be removable and/or replaceable. Any part of a conveyor or centrifuge disclosed herein, especially parts exposed to fluid flow, may be coated with a protective coating, hardfaced, and/or covered with tungsten carbide or similar material.

A "velocity decrease" chamber or area, in certain embodiments, is, optionally, located past the nozzle (feed tube) (e.g. to the right of the interior end of the feed tube in FIGS 2A, 2B and 5A', 5B". This unobstructed area may include space within a chamber.(e.g. within a solid-walled hollow member open at both ends) disposed between the feed tube exit and either conveyor fluid exit areas or, a radial acceleration apparatus within the conveyor. Fluid from the nozzle (e.g. two to two-and-one-half inches in internal diameter) moves through a chamber that disperses flowing fluid; provides a space to allow the fluid's velocity to decrease (velocity in the general direction of the horizontal or longitudinal axis of the centrifuge); and directs fluid to impact the impellers. Different interchangeable nozzles may be used. The nozzle exit end may be non-centrally located within the conveyor—i.e. not on the conveyor's longitudinal axis. A solid walled hollow member defining the chamber may be any suitable shape—e.g. but not limited to, conical, cylindrical, and/or triangular, square, rectangular, or polygonal in cross-section and any number of any known impellers, blades, or vanes may be used.

In certain embodiments fluid flows through the chamber and impacts a plurality of impellers that are connected to and rotate with the conveyor. The fluid impacts the impellers and is then moved radially outward by the blades toward the conveyor's flights. The impellers are configured and positioned to radially accelerate the fluid so that as the fluid passes the impellers outer edges, the fluid's speed (radial speed) is near or at the speed of a pool of material within the bowl—thus facilitating entry of this fluid into the pool or mass of fluid already in the bowl. By reducing or eliminating the speed differential between fluid flowing from the acceleration chamber and fluid already present in the bowl, turbulence is reduced, entry of solids of the entering fluid into the pool in bowl is facilitated, and more efficient solids separation results.

The present invention, in certain aspects, provides a centrifuge with a variable pneumatic backdrive or airbrake to control the differential speed of the conveyor. In one particular aspect a ROOTS XLP WHISPAIR blower available from the ROOTS DRESSER CO. is used to provide selectively variable braking for a gearbox pinion, thus varying the relative rotational speed of the conveyor in the bowl. In one aspect a typical known automatic boost system (e.g. to increase scroll-to-bowl speed or vice-versa) is used with the backdrive to inhibit or prevent plugging. Alternatively, for any embodiment herein the conveyor may be driven by a motor and a braking apparatus provided for the bowl to selectively adjust the conveyor/bowl rotative speed differential.

What follows are some of, but not all, the objects of this invention. In addition to the specific objects stated below for at least certain preferred embodiments of the invention, other objects and purposes will be readily apparent to one of skill in this art who has the benefit of this invention's teachings and disclosures. It is, therefore, an object of at least certain preferred embodiments of the present invention to provide:

New, useful, unique, efficient, nonobvious devices and methods for decanting centrifuges;

Such centrifuges with dispersed and/or non-focused flow of fluid from an interior entry area, through a conveyor, into a bowl;

Such centrifuges with a caged or skeleton conveyor;

Such centrifuges with reduced fluid turbulence, particularly at points or areas at which fluid exits a conveyor to enter a bowl;

Such centrifuges with a relatively short feed tube and/or one or more impellers impacted by fluid entering the centrifuge through a feed tube and/or with a chamber for dispersing fluid flow and/or to reduce its longitudinal velocity for directing fluid flow to the impellers);

Such centrifuges with a pneumatic backdrive to adjust and control conveyor speed or bowl speed; and Such centrifuges which effect increased settling and separation of solids.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIGS. 5A' and 5A" are partial side cross-section views of a decanting centrifuge according to the present invention.

DESCRIPTION OF EMBODIMENTS PREFERRED AT THE TIME OF FILING FOR THIS PATENT

Figure 1:
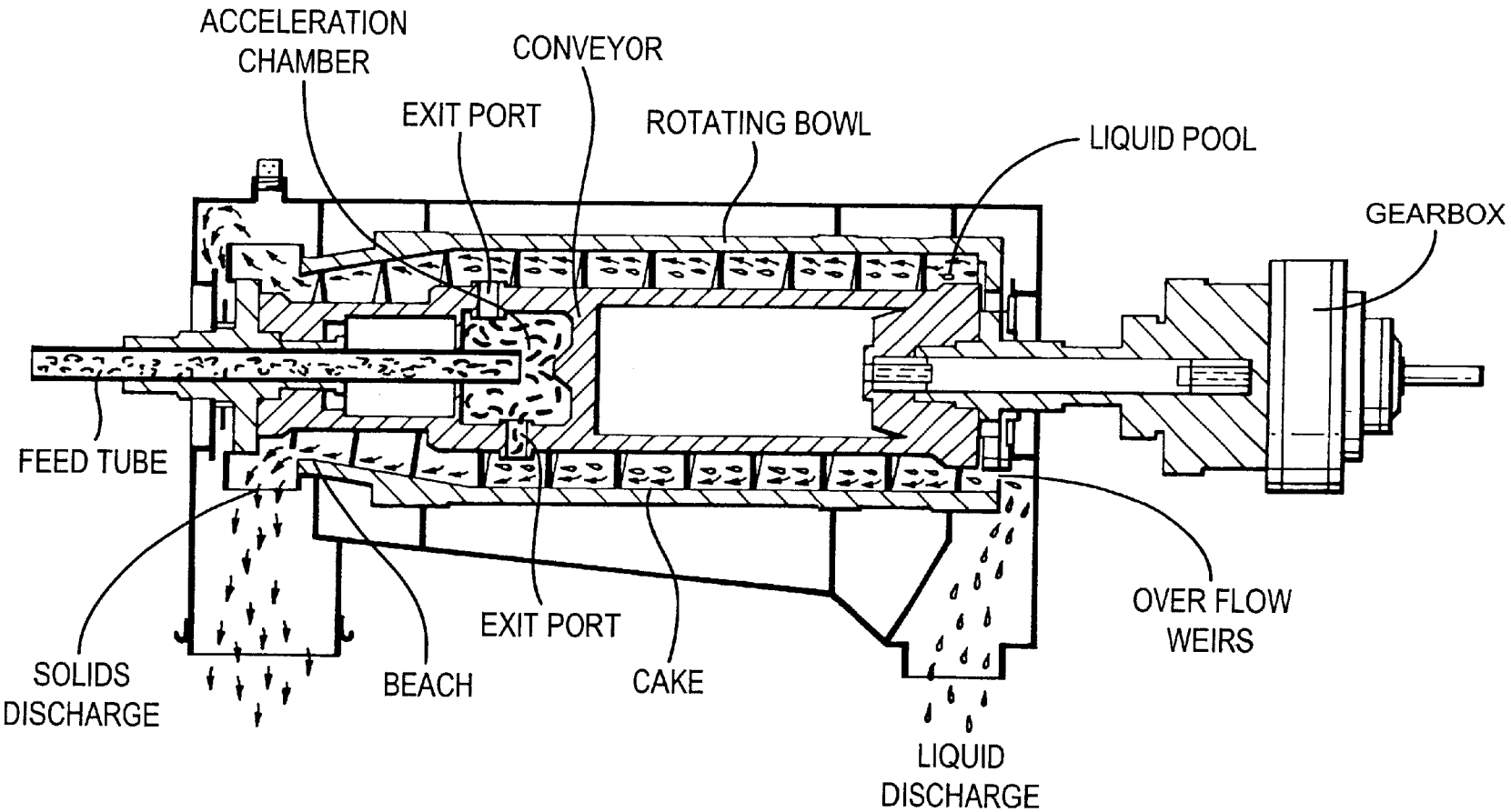
Fig. 1 PRIOR ART
FIG. 1 is a side cross-section view of a prior art decanting centrifuge.
Figure 2A:
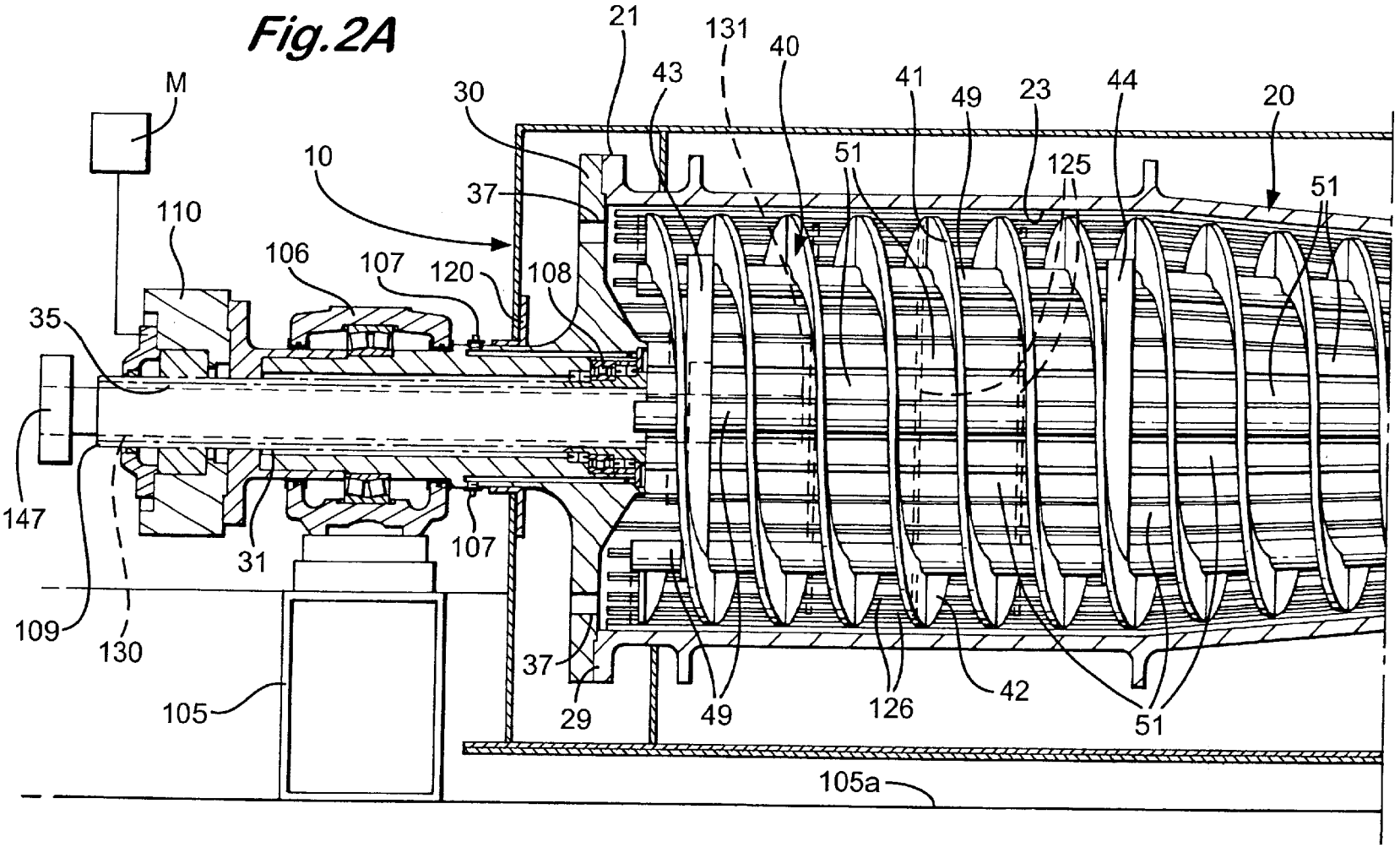
FIGS. 2A and 2B are partial side cross-section views of a decanting centrifuge according to the present invention.
Figure 2B:
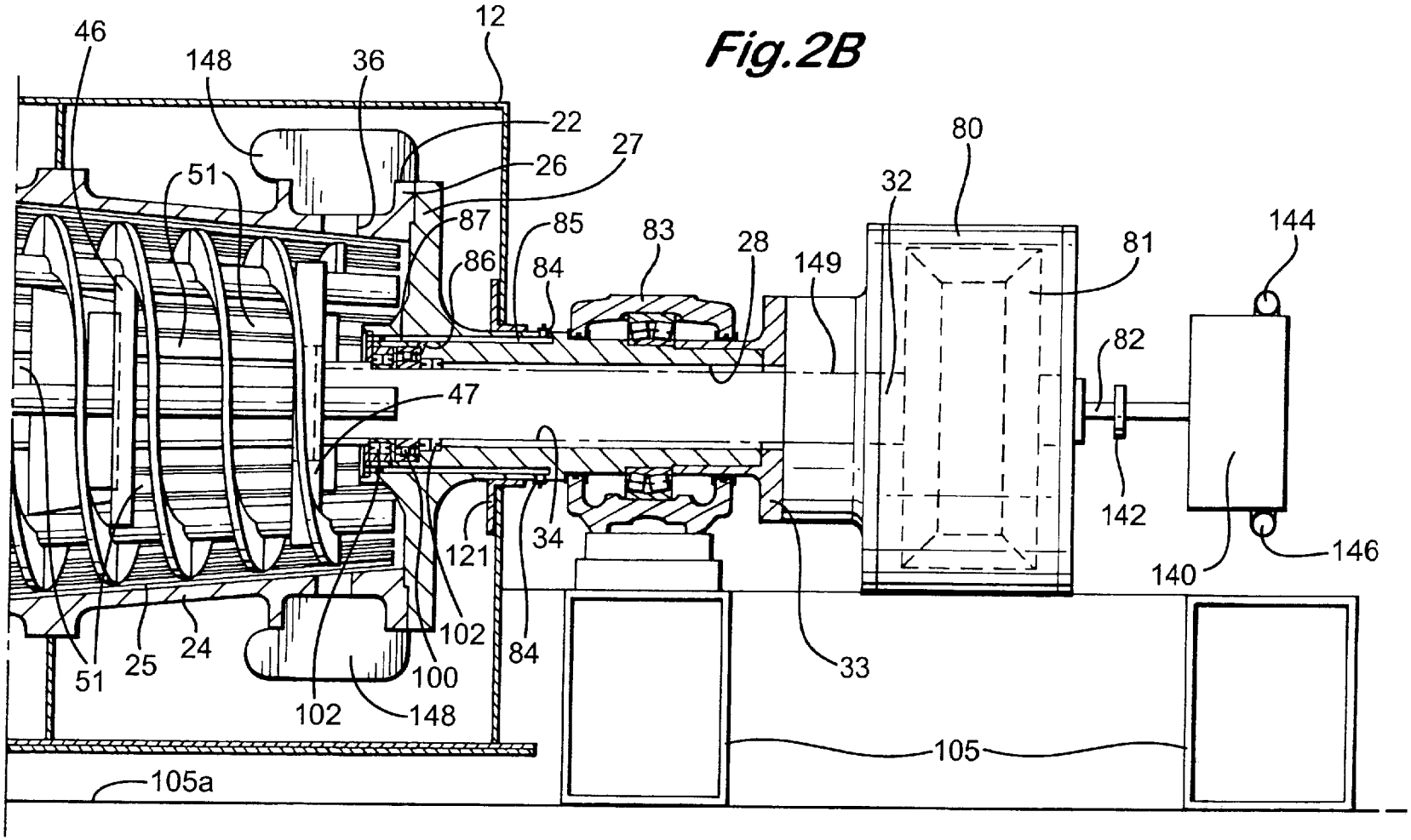
Figure 3A:
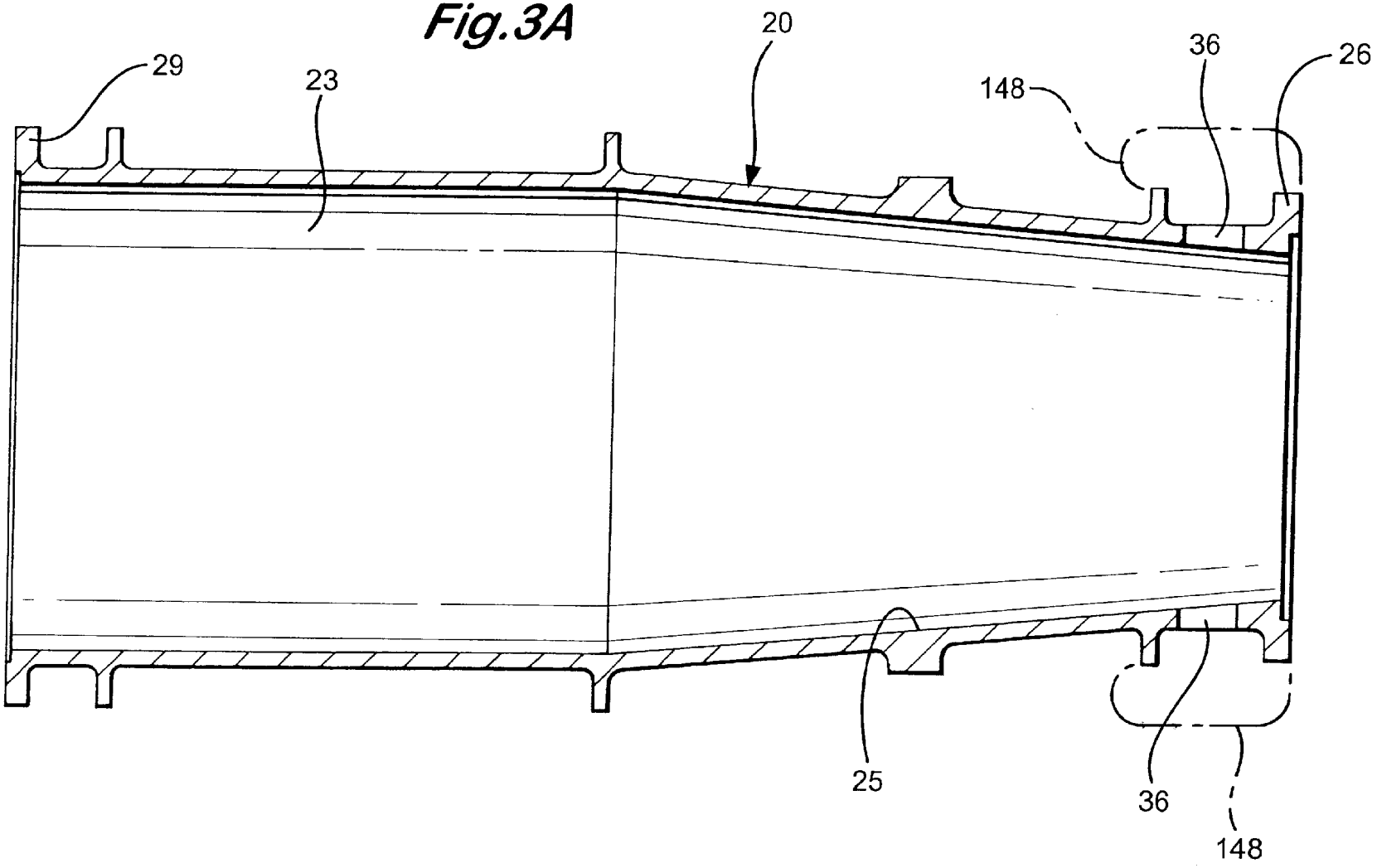
FIG. 3A is a side cross-section view of the bowl of the decanting centrifuge of FIG. 2.
Figure 3B:
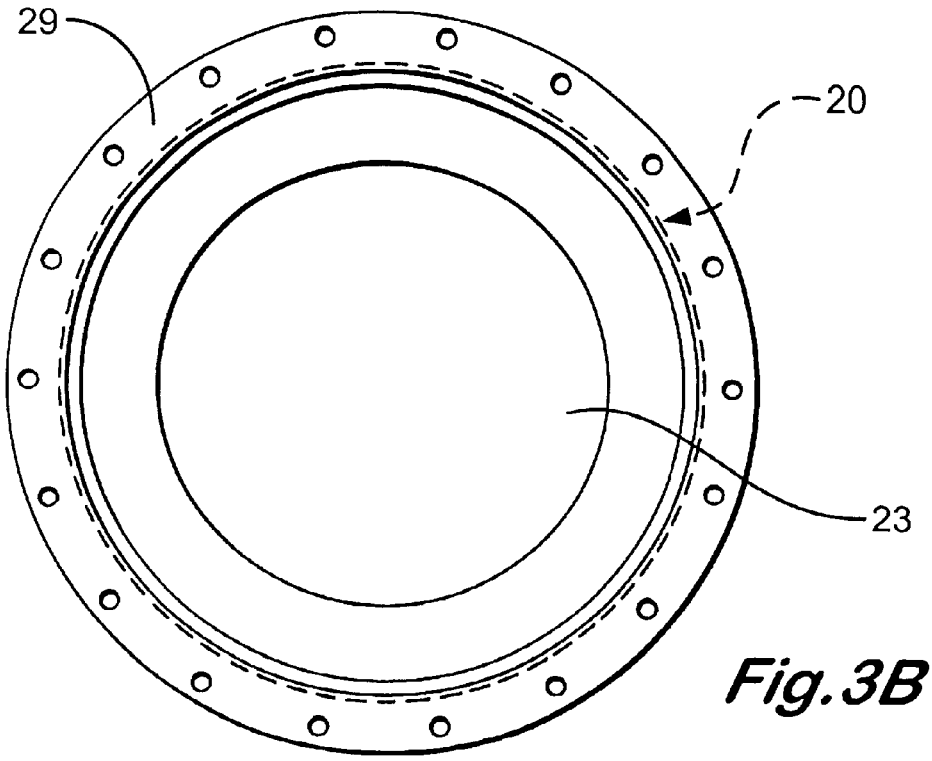
FIGS. 3B and 3C are end views of the bowl of FIG. 3A.
Figure 3C:
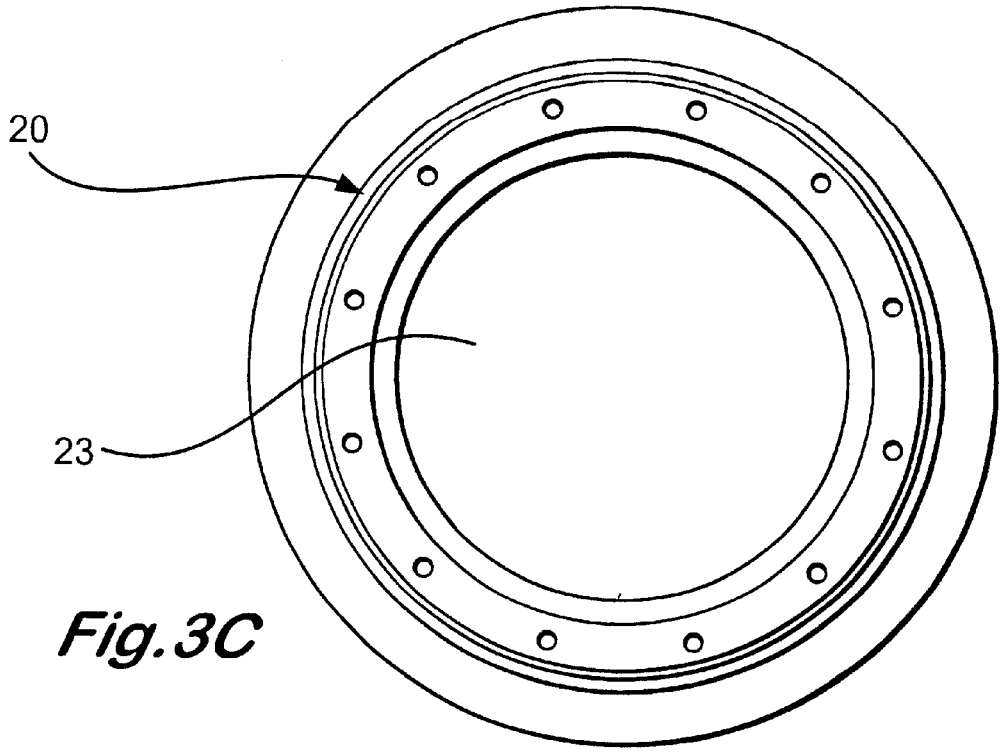

FIGS. 2A and 2B show a decanting centrifuge 10 according to the present invention which has an outer housing 12 within which is rotatable mounted a bowl 20 with a hollow interior 23. Within the hollow interior 23 of the bowl 20 is rotatably mounted a conveyor 40 that has a continuous helix or screw 41 that extends from a first end 21 of the bowl 20 to a second end 22 of the bowl 20. Supports 105 on a base 105*a* support the centrifuge (bowl, conveyor, outer housing, and other components). The supports 105 may themselves be supported on a skid.

A plurality of support rods 49 are disposed within the helix 41 and are connected at points of contact to flights or sections 42 of the helix 41, e.g. by bolting and/or welding. The flights 42 are sized so that they are separated a desired distance from the interior surface of the bowl 20 along the bowl's length. As is well known, the edges of the flights may be lined with side-by-side pieces or tiles made of sintered tungsten carbide or the edges themselves may be handfaced (as may any part of the apparatus). An end plate 43 is at one end of the helix 41, connected e.g. by welding, and an end plate 47 is at the other end.

Figure 4A:
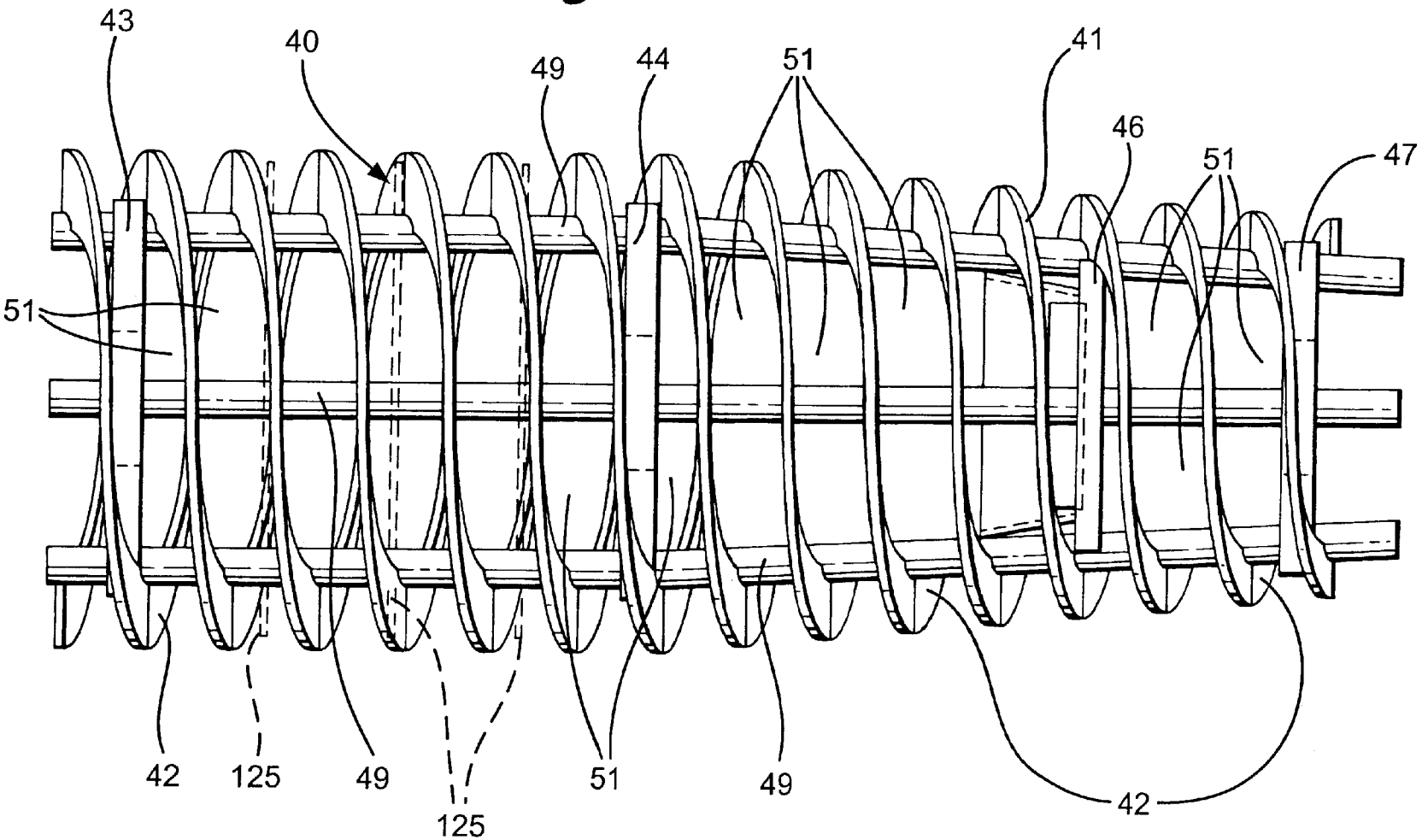
FIG. 4A is a side view of the conveyor of the centrifuge of FIG. 1
Figure 4B:
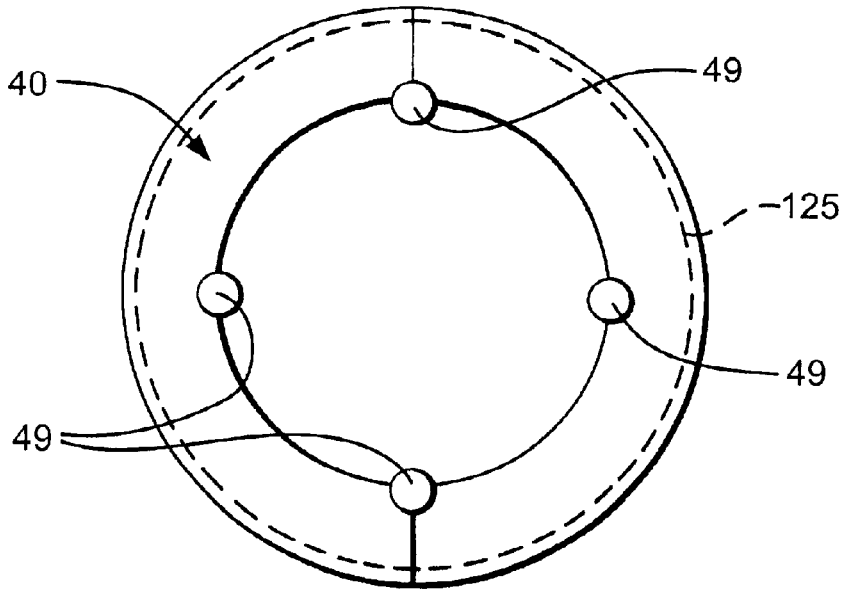
FIG. 4B is an end view of the conveyor of FIG. 4A.

Baffles 43, 44, and 46 are attached to the rods 49. Viewed on end these baffles are similar to the section of the conveyor 40 shown in FIG. 4B. The end baffles 43, 46 and plate 47 provide support and attachment points for the shafts (trunnions) that support the conveyor. Additional baffles may be used at any point in the conveyor for added strength and/or for apparatus detachment points.

Areas 51 between the rods 49 and the flights 42 (between each rod part and each flight part) are open to fluid flow therethrough. Alternatively portions of the conveyor may be closed off (i.e. areas between rod parts and flights are not open to fluid flow), e.g. but not limited to, closing off the left one quarter or one-third and/or the right one-quarter or one-third thereof; i.e., all or only a portion of the conveyor may be "caged". Due to the openness of the caged conveyor (and the fact that, in certain aspects, fluid is fed in a nonfocused manner and is not fed at a point or points adjacent the pool in the bowl or prior to the beach, and fluid is not fed from within the conveyor through a number of ports or orifices—as in the prior art fluid is fed out through several ports or areas that tend to focus fluid flow from the conveyor), solids in this fluid do not encounter the areas of relatively high turbulence associated with certain of the prior art feed methods and solids tend more to flow in a desired direction toward solids outlet(s) rather than in an undesired direction away from the beach and toward liquid outlets. Consequently, in certain, embodiments according to the present invention the relative absence or diminished presence of turbulence in the pool in the bowl permits the centrifuge to be run at relatively lower speed to achieve desired separation; e.g. in certain aspects of centrifuges according to the present invention a bowl may be run at between 900 and 3500 rpm and a conveyor at between 1 and 100 rpm.

The bowl 20 has a conical or "beach" end 24 with a beach section 25. The beach section 25 may be (and, preferably, is) at an angle, in certain preferred embodiments, of between 3 and 15 degrees to the longitudinal axis of the bowl 20.

A flange 26 of the bowl 20 is secured to a bowl head 27 which has a channel 28 therethrough. A flange 29 of the bowl 20 is, secured to a bowl head 30 which has a channel therethrough. A shaft 32 is drivingly interconnected with a gear system 81 of a transmission 80. A shaft 31 has a channel 35 therethrough through which fluid is introduced into the centrifuge 10. A motor M (shown schematically) interconnected (e.g. via one or more belts) with a driven sheave 110 selectively rotates the bowl 20 and its head 27 which is interconnected with the gear system 81 of the transmission 80 (and turning the bowl 20 thus results in turning of a trunnion or shaft 34).

A shaft 32 projecting from the transmission 80 is connected to the shaft 34. The transmission 80 includes a gear system 81 interconnected with pinion shaft 82 which can be selectively backdriven by a ROOTS (trademark) blower 140 or other suitable pneumatic backdrive device (shown schematically in FIG. 2B) connected thereto via a coupling 142 to change, via the gear system 18, the rotation speed of the shaft 32 and, therefore, of the conveyor 40. The blower 140 has an adjustable air inlet valve 144 and an adjustable air outlet valve 146 (the conveyor speed is adjustable by adjusting either or both valves). Alternatively a non-pneumatic backdrive may be used. The gear system 81 (shown schematically by the dotted line in the transmission 80) may be any known centrifuge gear system, e.g. but not limited to a known two-stage planetary star and cluster gear system.

Optionally, the shaft 82 is coupled to a throttle apparatus (not shown) which, in one aspect includes a pneumatic pump, e.g. an adjustable positive displacement pump [(e.g. air, pneumatic, (according to the present invention) or non pneumatic] connected to the shaft 82 to provide an adjustable backdrive.

Solids exit through four solids outlet 36 (two shown) in the bowl 20 and liquid exits through liquid outlets 37 in the bowl 20. There may be one, two, three, four, five, six or more outlets 36 and 37. There are, in one aspect, four spaced-apart outlets 37 (two shown).

The shaft 34 extends through a pillow block bearing 83 and has a plurality of grease ports 84 in communication with grease channels 85, 86 and 87 for lubrication of the bearings and shafts.

Bearings 100 adjacent the shaft 34 facilitate movement of the shaft 34. Internal bearings can be lubricated, ringed, and sealed by seals 102 (that retain lubricant).

An end 109 of the shaft 31 extends through the driven sheave 110.

Mount rings 120, 121 secured at either end of the bowl 20 facilitate sealing of the bowl 20 within the housing 12. Two plows 148 (one, two, three four or more) on the bowl 20 scrape or wipe the area around solids outlets 36 so the outlets are not plugged and maintain or increase product radial speed as the bowl rotates to facilitate solids exit. The plows also reduce bowl drag on the housing by reducing solids accumulation around solids exit points.

A feed tube 130 with a flange 147 extends through the interior of the input shaft 31. The feed tube 130 has an outlet end 131. Fluid to be treated flows into an inlet end (left side in FIG. 2A) of the feed tube.

Optionally, one or a plurality of spaced-apart pool surface diffusers 125 are secured to the conveyor and diffuse or interrupt the unwanted flow of floating solids away from the beach area 24. The diffusers 125 are shown in FIGS. 2A and 5B. Solids may tend to move in upper layers (slurry-like material with solids therein) of material flowing away from the beach area and toward the liquid outlets 37. Diffusers 125 extend into these upper layers so that the solids in the upper slurry layer are pushed down by the diffusers and/or hit the diffusers and fall down and out from the upper flowing slurry layer into lower areas or layers not flowing as fast and/or which are relatively stable as compared to the layers so that the solids can then continue on within the bowl toward the inner bowl wall and then toward the beach.

Optionally, a plurality of spaced-apart traction strips or rods 126 on the bowl 20 facilitate movement of the solids to the beach and facilitate agglomeration of solids and solids build up to facilitate solids conveyance.

FIGS. 5A' and 5A" illustrate a decanting centrifuge 210 like the centrifuge 10 of FIG. 2 (and like numerals indicate the same parts). The centrifuge 210 has a feed tube 230 with an exit opening 231 from which material to be processed exits and enters into a conical portion of a chamber 240 through an entrance opening another embodiment, the chamber 240 is deleted and the impellers 250 are extended toward the end of the feed tube (to the left in FIG. 5A") and, in one such embodiment, the end of the feed tube is within the impellers. Optionally, the parts related to the internal feed chamber (including mounting plate and pipe), impellers and nose member are all removably bolted to the conveyor so that they can be replaced. Alternatively, in one aspect, they are all permanently welded in place The same drive motor transmission, driven sheave, backdrive apparatus, bearings etc. as in FIGS. 2A and 2B may be used with the centrifuge of FIGS. 5A' and 5A".

The end of the feed 230 within the conveyor 40 extends through a mounting plate 242 and a hollow pipe 243. The pipe 243 and a portion of the chamber 240 are supported in a support member 244. A support ring 246, connected to rods 49 (two shown; four spaced-apart around the conveyor as in FIG. 2), supports the other end of the chamber 240. Impellers 250 secured to (welded, or bolted) (or the impellers and nose member are an integral piece, e.g. cast as a single piece) nose member 260 have forward end portions 252 that abut an end of the chamber 240 and project into a fluid passage end 247 of the chamber 240 from which fluid exits, from the chamber 240.

In one particular aspect the distance from the exit end 231 of the feed tube 230 to the fluid passage end 247 of the chamber 240 is about 36 inches. In other embodiments this distance is at least nineteen inches and preferably at least 20 inches. It is also within the scope of this invention for the exit end of the feed tube to be within the pipe 243. Alternatively, the chamber 240 may be deleted and the pipe 243 extended to any distance (to the right of the plate 242) within the conveyor 40 up to the impellers or to a point within them. The nose member 260 has a solid plate portion 262 and a nose 264. In one aspect all parts 240–260 are bolted or otherwise removably connected to the conveyor for easy removal and replacement. Alternatively, they may be welded in place. FIG. 5B illustrates (with dotted lines 125*a*, 125*b*, respectively) an outer edge and an inner edge of one of the generally circular pool surface solids diffusers.

Figure 5C:
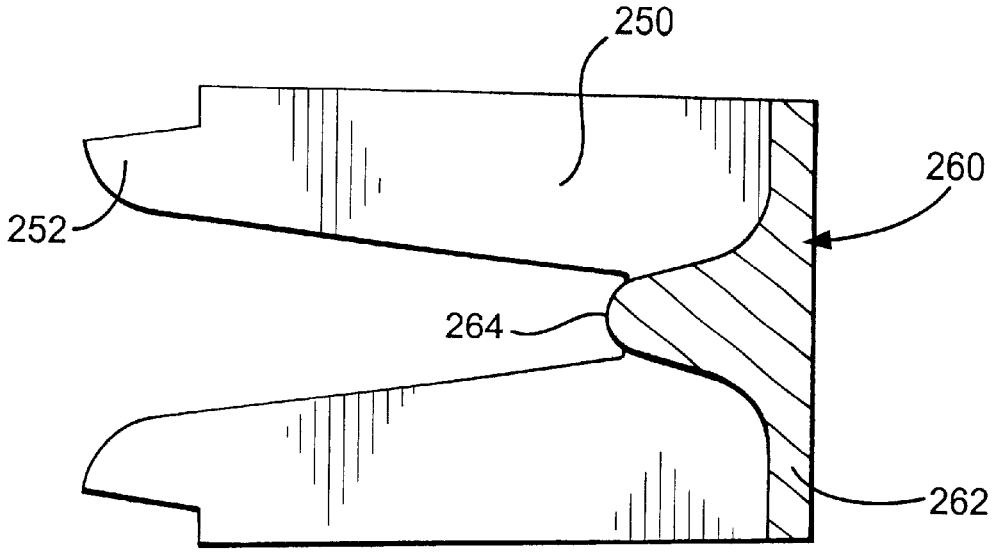
FIG. 5C is an enlargement of part of the centrifuge of FIG. 5A.
Figure 5B:
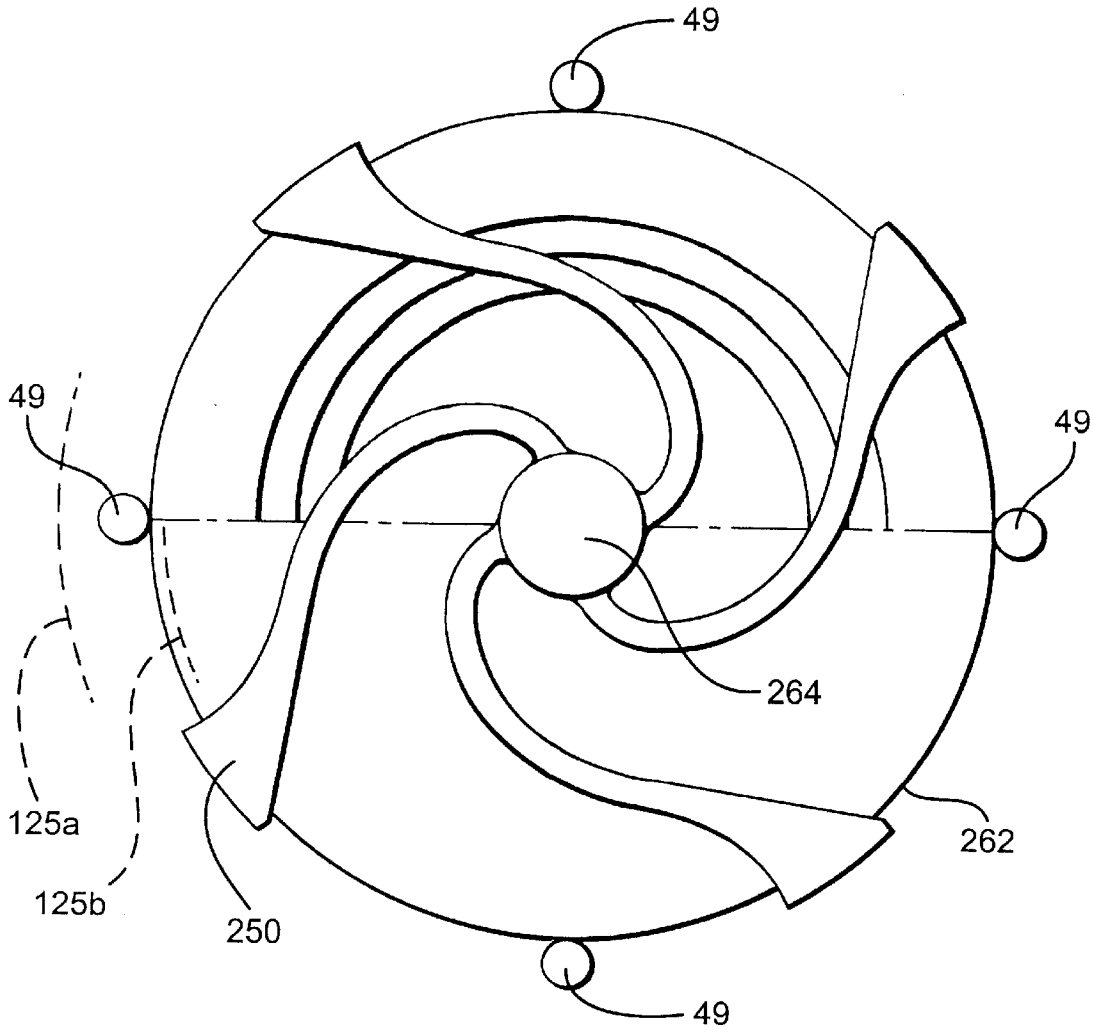
FIG. 5B is a cross-section view along line 5B–5B of FIG. 5A.

FIGS. 5B and 5C show the spaced-apart impellers 250 which are designed to radially accelerate fluid exiting the conveyor to pool surface speed to minimize pool disturbance by such feed. In another embodiment, the chamber 240 is deleted and the impellers 250 are extended toward the end of the feed tube (to the left in FIG. 5A) and, in one such embodiment, the end of the feed tube is within the impellers. Optionally, the parts related to the internal feed chamber (including mounting plate and pipe), impellers and nose member are all removably bolted to the conveyor so that they can be replaced. Alternatively, in one aspect, they are all permanently welded in place. The same drive motor transmission, driven sheave, backdrive apparatus, bearings etc. as in FIG. 2 may be used with the centrifuge of FIG. 5A.

In a typical prior art centrifuge the ratio of the internal diameter of the exit end of the feed tube to the length of free fluid travel within the conveyor (e.g. within a prior art acceleration chamber from the feed tube exit to the far end wall of the acceleration chamber) is about 4:1 or less. In certain embodiments according to the present invention this ratio is 7:1 or greater and in other aspects it is 10:1 or greater. In one particular centrifuge according to the present invention the internal feed tube exit diameter is about two and one-fourth inches and the distance from the feed tube exit to the leading edge (252) of an impeller (as in FIGS. 5A' and 5A") is about thirty six inches.

The present invention, therefore, provides in certain, but not necessarily all embodiments, a conveyor for a centrifuge, the conveyor having a length and a plurality of spaced-apart flight members spaced apart along the length of the conveyor, a plurality of support members (e.g. two, three, four, five or more) extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor. Such a method may include one or some of the following, in any possible combination: at least one pool surface diffuser connected to the conveyor; at least one accelerating impeller connected to the conveyor for accelerating the fluid; wherein the open areas extend along and around substantially the entire length of the conveyor or around only a part thereof; a hollow feed tube with a fluid exit end within the conveyor through which fluid to be treated by the centrifuge enters a space within the conveyor; at least one of the plurality of open areas located adjacent the fluid exit end of the feed tube; a chamber within the conveyor, part of the chamber having a fluid entry end encompassing the fluid exit end of the feed tube, the chamber for receiving fluid exiting from the fluid exit end of the feed tube, the fluid passing through the chamber and exiting a fluid passage end of the chamber, the fluid passage end spaced-apart from the chamber's fluid entry end, the fluid passage end within the conveyor; wherein the chamber is generally conical in shape with the fluid entry end, smaller in diameter than the fluid passage end; wherein fluid exiting from the fluid exit end of the feed tube has an exit velocity and the fluid at the fluid passage end has a passage velocity, the exit velocity greater than the.passage velocity; wherein the fluid exit end of the hollow feed tube has an internal diameter and the space within the conveyor includes an unobstructed space adjacent the feed tube fluid exit end, said space having a length, and a ratio of at least 7:1 or wherein the ratio is at least 10:1 of the internal diameter of the feed tube exit end the length of said space; at least one impellers for contacting fluid from the chamber, the impeller connected to the conveyor and for increasing the radial speed of the fluid prior to the fluid flowing out from the conveyor; wherein the at least one impeller is a plurality of spaced-apart impellers each with a central end connected to a central nose member mounted in the conveyor; wherein the impellers are for accelerating the fluid to a speed that is at least 95% of the speed of rotation of a pool of fluid to be treated in the bowl; wherein the chamber, the central nose member, and the at least one impeller are permanently secured to the conveyor; wherein the chamber, the central nose member, and the at least one impeller are removably connected to the conveyor; wherein the at least one pool surface solids diffuser is a plurality of spaced-apart pool surface solids diffusers (e.g. rings with openings therethrough); and/or the conveyor having a distal end smaller in diameter than an entry end at which fluid enters the conveyor, and at least one of the plurality of open areas at the distal end.

The present invention, therefore, provides in certain, but not necessarily all embodiments, a centrifuge including a bowl with a hollow interior and a first bowl end spaced-apart from a second bowl end, apparatus for selectively rotating the bowl, a conveyor rotatably mounted in the bowl, the conveyor comprising a plurality of spaced-apart flight members each having a length, a plurality of support members extending between and connected to the spaced-apart flight members, the support members spaced-apart around the spaced-apart flight members, and the spaced-apart flight members and the plurality of support members defining a plurality of open areas through which fluid to be treated by the centrifuge is flowable from within the conveyor apparatus for selectively rotating the conveyor, and apparatus for material entry (e.g. a feed tube) and exit (e.g. solids and liquid outlets) from the bowl. Such a method may include one or some of the following, in any possible combination: wherein the conveyor further comprises at least one pool surface solids diffuser connected to the conveyor; the conveyor having a distal end smaller in diameter than an entry end at which fluid enters the conveyor, and at least one of the plurality of open areas at the distal end; a control apparatus interconnected with the conveyor for selectively adjusting speed of rotation of the conveyor relative to the bowl; a control apparatus interconnected with the conveyor for selectively adjusting speed of rotation of the bowl relative to the conveyor; the conveyor having at least one or a plurality of accelerating impellers connected to the conveyor for accelerating the fluid; the conveyor with a hollow feed tube with a fluid exit end within the conveyor through which fluid to be treated by the centrifuge enters a space within the conveyor; the conveyor with at least one of the plurality of open areas located adjacent the fluid exit end of the feed tube; the conveyor with a chamber within the conveyor, part of the chamber having a fluid entry end encompassing the fluid exit end of the feed tube, the chamber for receiving fluid exiting from the fluid exit end of the feed tube, the fluid passing through the chamber and exiting a fluid passage end of the chamber, the fluid passage end spaced-apart from the chamber's fluid entry end, the fluid passage end within the conveyor; the conveyor with the chamber generally conical in shape with the fluid entry end smaller in diameter than the fluid passage end; the conveyor's parts configured, sized and positioned so that fluid exiting from the fluid exit end of the feed tube has an exit velocity and the fluid at the fluid passage end has a passage velocity, the exit velocity greater than the passage velocity; wherein the fluid exit end of the hollow feed tube has an internal diameter and the space within the conveyor includes an unobstructed space adjacent the feed tube fluid exit end, said space having a length, and a ratio of at least 7:1 of the internal diameter of the feed tube exit end the length of said space; the conveyor with at least one impeller for contacting fluid from the chamber, the impeller connected to the conveyor and for increasing the radial speed of the fluid prior to the fluid flowing out from the conveyor; the conveyor in which the at least one impeller is a plurality of spaced-apart impellers each with a central end connected to a central nose member mounted in the conveyor; the conveyor's impellers for accelerating the fluid to a speed that is at least 95% (or at least 99%) of the speed of rotation of a pool of fluid to be treated in the bowl; the conveyor with the chamber and the at least one impeller permanently secured to the conveyor; the conveyor with the chamber and the at least one impeller removably connected to the conveyor; the conveyor with at least one pool surface solids diffuser connected to the conveyor; the centrifuge bowl having a beach area, the conveyor further comprising the conveyor having a distal end smaller in diameter than an entry end at which fluid enters the conveyor, and at least one of the plurality of open areas adjacent the beach area so material to be treated flows out from the conveyor through said at least one of the plurality of open areas; wherein there are a plurality of open areas of the conveyor adjacent the beach area; a control apparatus interconnected with the conveyor for selectively adjusting speed of rotation of the conveyor relative to the bowl; wherein the control apparatus is a backdrive apparatus; wherein the backdrive apparatus is pneumatically powered; a control apparatus interconnected with the conveyor for selectively adjusting speed of rotation of the bowl relative to the conveyor wherein the control apparatus is a backdrive apparatus; and/or wherein the backdrive apparatus is pneumatically powered.

The present inventions therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, apparatus for selectively rotating the bowl and the conveyor and for differing rotational speed of the conveyor with respect to the bowl, apparatus for providing unfocused feed material from within the conveyor into the bowl, and apparatus for material exit from the bowl.

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, apparatus for selectively rotating the bowl and the conveyor and for differing rotational speed of the conveyor with respect to the bowl, apparatus for slowing down feed material within the conveyor before it exits the conveyor into the bowl, and apparatus means for material exit from the bowl.

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, apparatus for selectively rotating the bowl and the conveyor and for differing rotational speed, of the conveyor with respect to the bowl, apparatus for diffusing solids in a pool of feed material in the bowl, and apparatus for material exit from the bowl.

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, rotation apparatus for selectively rotating the bowl and the conveyor and for differing rotational speed of the conveyor with respect to the bowl, apparatus for pneumatically powered control apparatus for selectively controlling the differing rotation speed of the conveyor, and apparatus for material entry and exit from the bowl.

The present invention, therefore, provides in certain, but not necessarily all embodiments, a centrifuge for separating components of a feed material, the centrifuge with a bowl, with a hollow interior and a first bowl end spaced-apart from a second bowl end, the bowl having a beach area, a conveyor within the bowl for moving separated material from the first bowl end to the second bowl end, apparatus for selectively rotating the bowl and the conveyor and for differing rotational speed of the conveyor with respect to the bowl, the conveyor including a plurality of spaced-apart conveying members each having a length, a plurality of support members extending between and connected to the spaced-apart conveying members, the support members spaced-apart around the spaced-apart conveying members, and the spaced-apart conveying members and the plurality of support members defining a plurality of open areas through which fluid to be treated by the centrifuge is flowable out from within the conveyor to space between an exterior of the conveyor and an interior surface of the bowl and at least one of the open areas adjacent a portion of the beach area so that fluid to be treated by the centrifuge flows from said at least one open area to said portion of the beach area, and apparatus for material exit from the bowl.

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, the conveyor having a length and comprising a plurality of spaced-apart flight members spaced apart along the length of the conveyor, a plurality of support members extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor, a hollow feed tube with a fluid entry end outside the first bowl end and a fluid exit end within the conveyor through which feed material to be treated by the centrifuge enters a space within the conveyor, at least one of the plurality of open areas located further away from the first bowl end than the fluid exit end of the feed tube, apparatus for selectively rotating the bowl and the conveyor and for differing rotational speed of the conveyor with respect to the bowl, and apparatus for material exit from the bowl.

The present invention, therefore, provides in certain, but not necessarily all embodiments, a centrifuge for separating components of a feed material, the centrifuge with a bowl with a hollow interior and a first bowl end spaced-apart from a second bowl end, a conveyor within the bowl for moving separated material from the first bowl end to the second bowl end, the conveyor having a length and comprising a plurality of spaced-apart flight members spaced apart along the length of the conveyor, a plurality of support members extending between, and connected to the spaced-apart flight members, the support members spaced-apart around the plurality of spaced-apart flight members, the spaced-apart flight members and plurality of support members defining a plurality of open areas through which fluid to be treated by the centrifuge is flowable from within the conveyor, a hollow feed tube with a fluid exit end within the conveyor through which feed material to be treated by the centrifuge enters a space within the conveyor, a velocity decrease chamber in the conveyor, the fluid exit end discharging into the velocity decrease chamber within the conveyor, the velocity decrease chamber having an outer surface spaced-apart from an inner surface of the support members, apparatus for selectively rotating the bowl and the conveyor and for differing rotational speed of the conveyor with respect to the bowl, and apparatus for material exit from the bowl; and such a centrifuge with at least one of the plurality of open areas adjacent the outer surface of the velocity decrease chamber.

The present invention, therefore, provides in certain, but not necessarily all embodiments, a method for separating components of a feed material, the method introducing feed material into a centrifuge, the centrifuge like any disclosed herein according to the present invention separating components of the feed material within the centrifuge; and discharging from the bowl separated components of the feed material; and, such a method wherein the feed material includes liquid with solids entrained therein and the centrifuge separates solids from the liquid, the solids exiting from the bowl through at least one bowl solids exit port and the liquid exits from the bowl through at least one bowl liquid exit port which is spaced-apart from the bowl solids exit port; and any such method wherein the centrifuge includes a hollow feed tube with a fluid exit end within the conveyor through which fluid to be treated by the centrifuge enters a space within the conveyor, and the fluid exit end of the hollow feed tube has an internal diameter and the space within the conveyor includes an unobstructed space adjacent the feed tube fluid exit end, said space having a length, and a ratio of at least 7:1 of the internal diameter of the feed tube exit end the length of said space; and any such method wherein there is at least one impeller for contacting fluid from the chamber, the at least one impeller connected to the conveyor and for increasing the radial speed of the fluid prior to the fluid flowing out from the conveyor, wherein the at least one impeller is a plurality of spaced-apart impellers each with a central end connected to a central nose member mounted in the conveyor, and wherein the impellers accelerate the fluid to a speed that is at least 95% of the speed of rotation of a pool of fluid to be treated in the bowl and the method also includes radially accelerating with the impellers the fluid to at least 95% (or to at least 99%) of the rotational speed of the pool of fluid in the bowl prior to the fluid flowing out from the conveyor into space between the outer edge of the spaced-apart flight members and an interior surface of the bowl.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A conveyor for a centrifuge, the centrifuge having a beach area, the conveyor having a length and comprising a plurality of spaced-apart flight members spaced apart along the length of the conveyor, a plurality of support members extending between, and connected to the spaced-apart flight members, the support members spaced-apart around the plurality of spaced-apart flight members, the plurality of spaced-apart flight members and the plurality of spaced-apart support members defining an interior of the conveyor, a hollow feed tube with a fluid exit end within the conveyor through which fluid to be treated enters a space within the conveyor, the spaced-apart flight members and plurality of support members defining a plurality of open areas through which fluid to be treated is flowable out from within the conveyor, the conveyor having a distal end smaller in diameter than an entry end at which fluid enters the conveyor, and a plurality of the plurality of open areas at the distal end, the distal end of the conveyor positionable adjacent the beach area of the centrifuge, a plurality of spaced-apart accelerating impellers within the distal end of the conveyor for accelerating the fluid to be treated, each impeller of the plurality of spaced-apart accelerating impellers adjacent and spanning multiple opening areas of the plurality of open areas so that fluid accelerated by the plurality of spaced-apart accelerating impellers is flowable from the impellers out through the multiple open areas to the beach area of the centrifuge.

2. The conveyor of claim 1 further comprising at least one pool surface diffuser connected to the conveyor.

3. The conveyor of claim 1 wherein the plurality of open areas extend along substantially the entire length of the conveyor.

4. The conveyor of claim 1 further comprising each impeller connected to the conveyor and for increasing the radial speed of the fluid prior to the fluid flowing out from the conveyor.

5. The conveyor of claim 4 further comprising a nose member mounted within the conveyor and within the impellers, and wherein each impeller has an end connected to the nose member.

6. The conveyor of claim 5 wherein the impellers are for accelerating the fluid to a speed that is at least 95% of a speed of rotation of a pool of fluid to be treated in the centrifuge.

7. The conveyor of claim 5 wherein the nose member and the impellers are permanently secured to the conveyor.

8. The conveyor of claim 5 wherein the nose member and the impellers are removably connected to the conveyor.

9. The conveyor of claim 5 wherein the nose member is positioned so that fluid from the hollow feed tube passes along a substantial portion of the impellers prior to impacting the nose member.

10. The conveyor of claim 5 wherein the impellers curve out from the nose member.

11. A centrifuge comprising a bowl with a hollow interior and a first bowl end spaced-apart from a second bowl end and a beach area, apparatus for selectively rotating the bowl, a conveyor rotatably, mounted in the bowl, the conveyor having a length and comprising a plurality of spaced-apart flight members spaced apart along the length of the conveyor, a plurality of support members extending between, and connected to the spaced-apart flight members, the support members spaced-apart around the plurality of spaced-apart flight members, the plurality of spaced-apart flight members and the plurality of spaced-apart support members defining an interior of the conveyor, a hollow feed tube with a fluid exit end within the conveyor through which fluid to be treated enters a space within the conveyor, the spaced-apart flight members and plurality of support members defining a plurality of open areas through which fluid to be treated is flowable out from within the conveyor into the bowl, the conveyor having a distal end smaller in diameter than an entry end at which fluid enters the conveyor, and a plurality of the plurality of open areas at the distal end, the distal end of the conveyor adjacent the beach area of the bowl, a plurality of spaced-apart accelerating impellers within the distal end of the conveyor for accelerating the fluid to be treated, each impeller of the plurality of spaced-apart accelerating impellers adjacent and spanning multiple opening areas of the plurality of open areas so that fluid accelerated by the plurality of spaced-apart accelerating impellers is flowable from the impellers out through the multiple open areas to the beach area, and apparatus for rotating the conveyor.

12. The centrifuge of claim 11 wherein the centrifuge further comprises at least one pool surface solids diffuser connected to the conveyor.

13. The centrifuge of claim 11 further comprising a control apparatus interconnected with the conveyor for selectively adjusting speed of rotation of the conveyor relative to the bowl.

14. The centrifuge of claim 11 further comprising a control apparatus interconnected with the conveyor for selectively adjusting speed of rotation of the bowl relative to the conveyor.

15. The centrifuge of claim 11 further comprising the conveyor further comprising at least one of the plurality of open areas located adjacent the fluid exit end of the hollow feed tube.

16. The centrifuge of claim 11 further comprising the conveyor further comprising the impellers for accelerating the fluid to a speed that is at least 95% of a speed of rotation of a pool of fluid to be treated in the bowl.

17. The centrifuge of claim 11 further comprising the impellers are permanently secured to the conveyor.

18. The centrifuge of claim 11 further comprising the impellers are removably connected to the conveyor.

19. The centrifuge of claim 11 further comprising a plurality of the plurality of open areas adjacent the beach area.

20. The centrifuge of claim 11 further comprising a control apparatus interconnected with the conveyor for selectively adjusting speed of rotation of the conveyor relative to the bowl wherein the control apparatus is a backdrive apparatus.

21. The centrifuge of claim 20 wherein the backdrive apparatus is pneumatic powered.

22. The centrifuge of claim 11 further comprising a control apparatus interconnected with the conveyor for selectively adjusting speed of rotation of the bowl relative to the conveyor wherein the control apparatus is a backdrive apparatus.

23. The centrifuge of claim 22 wherein the backdrive apparatus is pneumatic powered.

24. A method for separating components of a feed material, the method comprising introducing feed material into a centrifuge, the centrifuge comprising a bowl with a hollow interior and a first bowl end spaced-apart from a second bowl end and a beach area, apparatus for selectively rotating the bowl, a conveyor rotatably mounted in the bowl, the conveyor having a length and comprising a plurality of spaced-apart flight members spaced apart along the length of the conveyor, a plurality of support members extending between, and connected to the spaced-apart flight members, the support members spaced-apart around the plurality of spaced-apart flight members, the plurality of spaced-apart flight members and the plurality of spaced-apart support members defining an interior of the conveyor, a hollow feed tube with a fluid exit end within the conveyor through which fluid to be treated enters a space within the conveyor, the spaced-apart flight members and plurality of support members defining a plurality of open areas through which fluid to be treated is flowable out from within the conveyor into the bowl, the conveyor having a distal end smaller in diameter than an entry end at which fluid enters the conveyor, and a plurality of the plurality of open areas at the distal end, the distal end of the conveyor positionable adjacent the beach area of the centrifuge, a plurality of spaced-apart accelerating impellers within the distal end of the conveyor for accelerating the fluid to be treated, each impeller of the plurality of spaced-apart accelerating impellers adjacent and spanning multiple opening areas of the plurality of open areas so that fluid accelerated by the plurality of spaced-apart accelerating impellers is flowable from the impellers out through the multiple open areas to the bench area, apparatus for rotating the conveyor, rotating the bowl and the centrifuge to separate components of the feed material within the centrifuge, and discharging from the bowl separated components of the feed material.

25. The method of claim 24 wherein the feed material includes liquid with solids entrained therein and the centrifuge separates solids from the liquid, the solids exiting from the bowl through at least one solids exit port and the liquid exiting from the bowl through at least one liquid exit port which is spaced apart from the at least one solids exit port.

26. The method of claim 24 further comprising radially accelerating with the impellers the fluid to at least 95% of the rotational speed of the pool of fluid in the bowl prior to the fluid flowing out from the conveyor into space between the outer edge of the spaced-apart flight members and an interior surface of the bowl.

* * * * *